US005688139A

United States Patent [19]

Gust et al.

[11] Patent Number: 5,688,139

[45] Date of Patent: Nov. 18, 1997

[54] FLUORESCENT LAMP HOLDER

[75] Inventors: James M. Gust, Wolcottville; John W. Burwell, Rome City; Roger W. Young, Millersburg, all of Ind.

[73] Assignee: Lyall Assemblies, Inc., Albion, Ind.

[21] Appl. No.: 551,897

[22] Filed: Oct. 23, 1995

[51] Int. Cl.[6] ..... H01R 33/02

[52] U.S. Cl. ..... 439/239; 439/159

[58] Field of Search ..... 439/226–229, 439/236, 239–244, 159

[56] References Cited

U.S. PATENT DOCUMENTS

| | | | |
|---|---|---|---|
| 2,282,875 | 5/1942 | Mueller | 439/159 |
| 2,284,376 | 5/1942 | De Reamer et al. | 439/239 |
| 2,339,751 | 1/1944 | Beal | 439/241 |
| 2,616,943 | 11/1952 | Werd et al. | 439/241 |
| 2,623,088 | 12/1952 | Axberg | 439/241 |
| 3,781,759 | 12/1973 | Shelly, Jr. | 439/233 |

*Primary Examiner*—Hien Vu

*Attorney, Agent, or Firm*—Taylor & Associates, P.C.

[57] ABSTRACT

The invention is directed to a lamp holder for carrying a fluorescent lamp, including two contact pins, with each contact pin having a diameter. A socket includes an inner hub, two slots and a conductor. The two slots are disposed on opposite sides of the inner hub. A spring biases the contact pins out of the slots. The conductor is associated with each slot, and is configured to engage each contact pin of the fluorescent lamp. The conductor and the inner hub define a clearance distance therebetween in a direction transverse to a longitudinal direction of each slot, with the clearance distance at all times being greater than the diameter of the contact pins. The clearance distance allows the contact pins to be moved away from the conductor by the spring, to thereby prevent electrical arcing when one of the contact pins is not fully engaged with the conductor.

13 Claims, 1 Drawing Sheet

FLUORESCENT LAMP HOLDER

BACKGROUND OF THE INVENTION

1. Field of the Invention

The present invention relates to lamp sockets, and, more particularly, to fluorescent lamp sockets.

2. Description of the Related Art

Fluorescent lamps, as known, include a glass tube coated on the inside with phosphor powders which fluoresce when excited by ultraviolet light. The glass tube is filled with rare gases (such as argon, neon, and krypton) and a small amount of mercury, and operates at a relatively low pressure. Electrodes are mounted within the glass tube and emit electrons during operation. The electrons are accelerated by the voltage across the tube until they collide with mercury atoms, causing the mercury atoms to be ionized and excited. When the mercury atoms return to their normal state, photons corresponding to mercury spectral lines in both the visible and ultraviolet region are generated, thereby exciting the phosphor coating on the inside of the tube to luminance.

To start a fluorescent lamp, electron emission from the electrodes may be induced in one of two ways. First, a filament electrode may be heated by passing current therethrough. Secondly, a high voltage which is sufficient to start an electric discharge in the lamp may be applied across the lamp without preheating the electrodes. Instant start circuits which are commonly used today typically employ the latter method of inducing electron emission from the electrodes. Instant start circuits use a ballast which applies a high voltage (e.g., up to 848 VAC) at a high frequency. Such instant start ballasts are much more energy efficient than older style ballasts which heat the electrodes.

A problem associated with fluorescent lamps utilizing an instant start ballast is that the high voltage applied to the electrodes by the ballast can also cause electrical arcing to occur between a contact pin of the fluorescent lamp and the conductor of the fluorescent lamp holder in which the fluorescent lamp is installed. For example, known fluorescent lamp holders may include slots for receiving the two respective contact pins of the fluorescent lamp therein. However, with conventional designs, if the contact pins are not correctly inserted into the socket, it is possible for one of the contact pins to be fully disengaged with the conductor, with the other contact pin being disposed a small distance away from the conductor (e.g., 0.030 inch). Alternatively, it is possible for each of the contact pins to be disposed a small distance away from the conductor (e.g., 0.030 inch). In either event, the high voltage applied to the contact pins by the instant start ballast may result in electrical arcing between the conductor and the contact pin disposed the small distance therefrom. Such electrical arcing is clearly not desirable.

Similarly, with fluorescent lamps utilizing a rapid start ballast, a two-piece conductor is used to contact each respective contact pin. It is possible for one of the contact pins to be fully engaged with the conductor, while the other contact pin is disposed a small distance away from the conductor (e.g., 0.030 inch). Under such conditions, the high voltage applied to the conductor (e.g., 220 VAC) may result in electrical arcing between the conductor and contact pins.

What is needed in the art is a fluorescent lamp holder which prevents electrical arcing between a conductor of the lamp holder and the contact pins of a fluorescent lamp.

SUMMARY OF THE INVENTION

The present invention provides a lamp holder for a fluorescent lamp which prevents electrical arcing between a fluorescent tube conductor of the lamp holder and the contact pins of a fluorescent lamp.

The invention comprises, in one form thereof, a lamp holder for carrying a fluorescent lamp, including two contact pins, with each contact pin having a diameter. A socket includes an inner hub, two slots and a conductor. The two slots are disposed on opposite sides of the inner hub. A spring biases the contact pins out of the slots. The conductor is associated with each slot, and is configured to engage each contact pin of the fluorescent lamp. The conductor and the inner hub define a clearance distance therebetween in a direction transverse to a longitudinal direction of each slot, with the clearance distance at all times being greater than the diameter of the contact pins. The clearance distance allows the contact pins to be moved away from the conductor by the spring, to thereby prevent electrical arcing when either one of the contact pins is not fully engaged with the conductor.

An advantage of the present invention is that electrical arcing between the contact pins of the fluorescent lamp and the lamp holder is prevented. A clearance distance of greater than the diameter of the fluorescent tube contact pins is formed between the conductor and contact pins. The tube is partially ejected from the socket if not positively seated.

Another advantage is that electrical arcing between the contact pins of the fluorescent lamp and the lamp holder is prevented, while at the same time allowing single-handed installation of the fluorescent lamp within the lamp holder.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
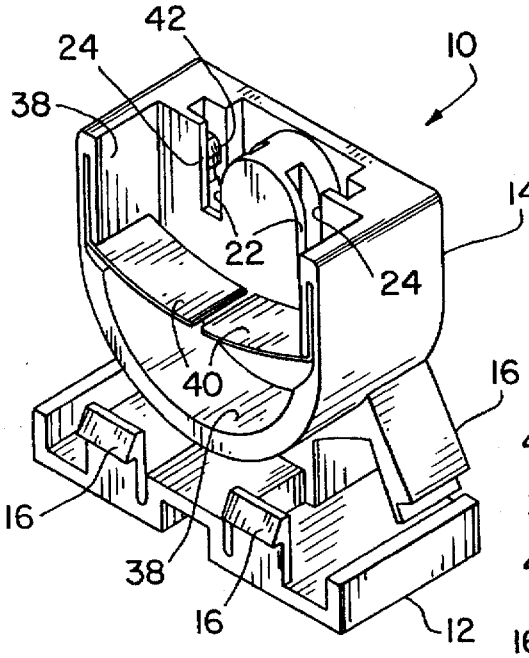
FIG. 1 is a perspective view of an embodiment of a fluorescent lamp holder of the present invention.
Figure 2:
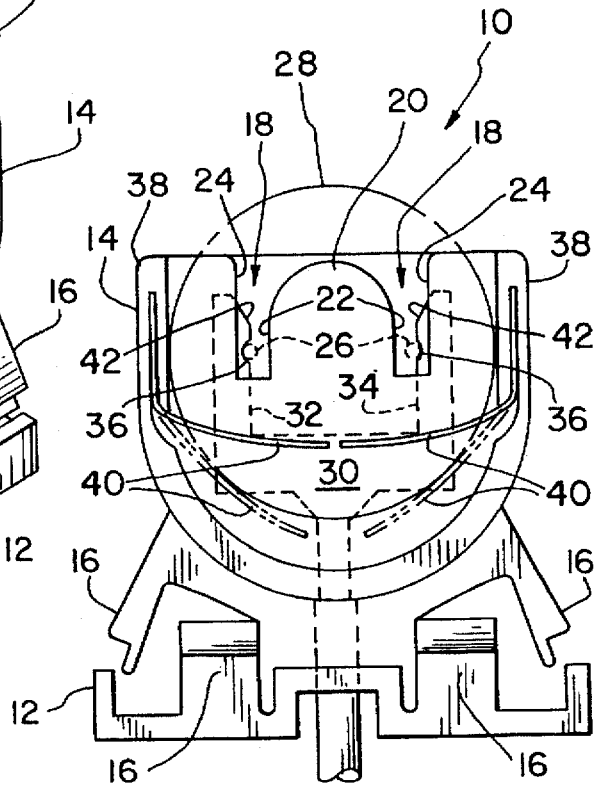
FIG. 2 is a front view of the fluorescent lamp holder shown in FIG. 1.
Figure 3:
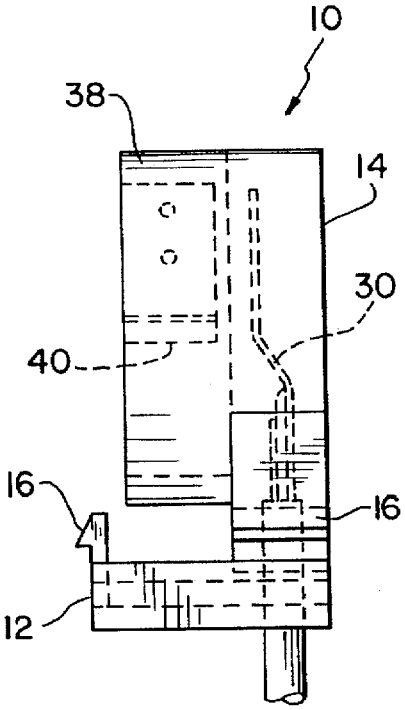
FIG. 3 is a side view of the fluorescent lamp holder shown in FIGS. 1 and 2.

Referring now to the drawings and particularly to FIG. 1–3, an embodiment of a lamp holder assembly including a fluorescent lamp holder 10 of the present invention is shown. Lamp holder 10 generally includes a base 12 and socket 14.

Base 12 is configured for attachment to a housing of a fluorescent lamp fixture (not shown). In the embodiment shown, base 12 includes resilient clamps 16 which provide for snap fitting engagement with the housing of the fluorescent lamp fixture.

Socket 14 includes two parallel slots 18 disposed on opposite sides of an inner hub 20. Slots 18 are defined by respective pairs of parallel walls 22, 24. Slots 18 are configured for receiving respective contact pins 26 of a fluorescent lamp 28 (shown in phantom lines in FIG. 2) therein.

A conductor 30 is of one-piece construction and is disposed within socket 14. Such a one-piece conductor is typically used with an instant start ballast. Conductor 30 includes a first contact portion 32 associated with one of slots 18, and a second contact portion 34 associated with the other of slots 18. Each of first and second contact portions 32 and 34 have a notch 36 therein which is configured to receive and directly engage a corresponding contact pin 26. Notches 36 are each disposed adjacent to an associated parallel wall 24, and away from an associated parallel wall 22. Thus, first and second contact portions 32 and 34 are disposed on a side of a respective slot 18 which is generally opposite from inner hub 20. In the embodiment shown in FIGS. 1–3, parallel walls 22 are defined by inner hub 20.

In the embodiment shown in FIG. 1–3, notches 36 are formed on conductor 30 by cutting out a portion of first and second contact portions 32 and 34. However, it is also to be understood that first and second contact portions 32 and 34 could be bent or formed to define notches 36.

First and second contact portions 32 and 34, together with parallel walls 22 of inner hub 20, define a clearance distance (not numbered) therebetween which is at all times greater than the diameter of contact pins 26. The clearance distance is measured in a direction transverse to a longitudinal direction of slots 18 (e.g., perpendicular to parallel walls 22), and allows contact pins 26 to be moved away from conductor 30 by a spring mechanism discussed below, when one of contact pins 26 is not received within a corresponding notch 36. That is, the clearance distance between first and second contact portions 32 and 34 and an associated parallel wall 22 is greater than the diameter of contact pins 26 regardless of whether contact pins 26 are engaged or disengaged with notches 36 of conductor 30.

In the embodiments shown in FIGS. 1–3, the clearance distance between first and second contact portions 32 and 34 and associated parallel wall 22 is the same. However, it is also to be understood that the clearance distance does not have to necessarily be the same, as long as contact pin 26 is free to pass between the first or second contact portions 32, 34 and the inner hub at all times, when one of the contact pins 26 is not engaged within an associated notch 36. The clearance distance allows fluorescent lamp 28 and contact pins 26 to be biased away from conductor 30, whereby arcing between contact pins 26 and conductor 30 is prevented.

Socket 14 also includes an axially projecting flange 38 which is attached to and carries resilient springs 40. Springs 40, which in the embodiments shown are in the form of leaf springs, bias contact pins 26 out of slots 18. More particularly, when fluorescent lamp 28 is in an installed position within socket 10 as shown in FIG. 2, springs 40 are deflected by fluorescent lamp 28 to the position shown in phantom lines in FIG. 2. Springs 40 thus exert a force on fluorescent lamp 28, and thereby also exert a force on contact pins 26 in a direction out of slots 18.

In use, fluorescent lamp 28 is aligned relative to lamp holder 10 such that contact pins 26 are received within slots 18. Contact pins 26 engage a beveled edge 42 and deflect first and second contact portions 32, 34, thereby allowing contact pins 26 to be received within and directly engaged by notches 36. As fluorescent lamp 28 is received within lamp holder 10, fluorescent lamp 28 biases springs 40 to the position shown in phantom lines in FIG. 2. When each contact pin 26 is received within a corresponding notch 36 of conductor 30, the force exerted on lamp 28 by springs 40 is not sufficient to dislodge contact pins 26 from notches 36. However, if one of the contact pins 26 becomes disengaged with an associated notch 36, springs 40 bias both of contact pins 26 to move contact pins 26 out of slots 18 and thereby prevent electrical arcing between contact pins 26 and conductor 30 regardless of mounting position. The clearance distance between first and second contact portions 32, 34 and inner hub 20 is sufficient to allow each of contact pins 26 to be moved out of the respective slots 18 and tube 28 partially out of socket 14 when one of contact pins 26 becomes disengaged with an associated notch 36.

In the embodiment shown in FIG. 1–3, socket 14 is provided with parallel slots 18. However, it is also to be understood that socket 14 may include slots which are disposed other than parallel to each other. For example, socket 14 may include one or more slots disposed in communication with each other which will allow the fluorescent lamp to be inserted therein and twisted into position such that the contact pins engage the conductor. A necessary criterion with other slots that may be formed in socket 14 is that the contact pins must be free to be moved away from the conductor if one of the pins becomes disengaged from the conductor, thereby preventing arcing therebetween.

Figure 4:
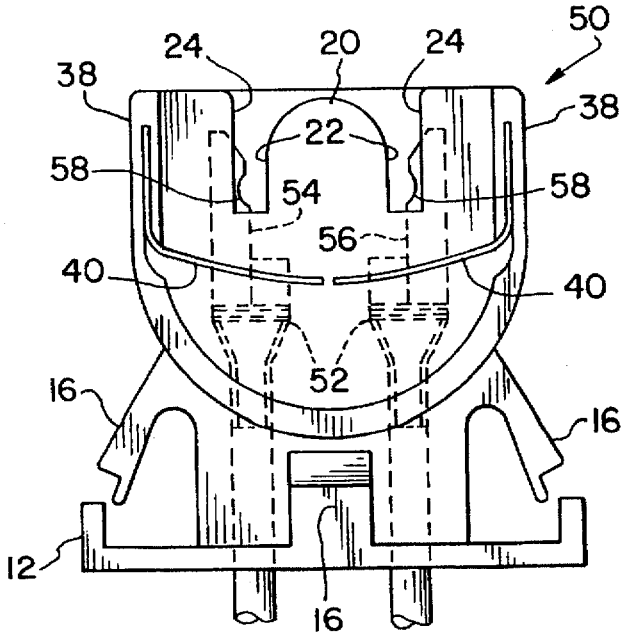
FIG. 4 is a front view of another embodiment of a fluorescent lamp holder of the present invention.

Referring now to FIG. 4, another embodiment of a fluorescent lamp holder 50 of the present invention is shown. Lamp holder 50 is similar to lamp holder 10 shown in FIGS. 1–3. However, conductor 52 is of two-piece construction, and includes a first contact portion 54 and a second contact portion 56. Such a two-piece conductor is typically used with a rapid start ballast. First and second contact portions 54, 56 include respective notches 58 for receiving and engaging the contact pins of a fluorescent lamp therein. In other respects, lamp holder 50 is generally the same as lamp holder 10 shown in FIGS. 1–3, with a similar method of use. Accordingly, common reference numbers are used for parts which are generally the same in the embodiment shown in FIGS. 1–3 and in the embodiment shown in FIG. 4.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A lamp holder for carrying a fluorescent lamp, the flourescent lamp including two contact pins, with each contact pin having a diameter, said lamp holder comprising:

a socket including:

an inner hub;

two slots disposed on opposite sides of said inner hub; and a conductor associated with each said slot, said conductor including a first contact portion and second contact portion, each of said first contact portion and said second contact portion including an edge with a notch therein for engaging a respective one of the contact pins of the fluorescent lamp, each said edge and said notch disposed within a respective said slot and adjacent to said inner hub, each said edge and said inner hub defining a clearance distance therebetween in a direction transverse to a longitudinal direction of each said slot, said clearance distance at all times, both when the contact pins are engaged and not engaged with said two notches in said conductor, being greater than the diameter of the contact pins.

2. The lamp holder of claim 1, wherein said conductor is disposed on a side of said slot which is generally opposite from said inner hub.

3. The lamp holder of claim 1, wherein said conductor comprises a one-piece conductor.

4. The lamp holder of claim 1, wherein said conductor comprises a first contact portion and a separate, second contact portion.

5. The lamp holder of claim 1, wherein each said slot is configured for receiving one of the contact pins therein, and further comprising a spring for biasing the contact pins out of said slots.

6. A lamp holder for carrying a fluorescent lamp, the fluorescent lamp including two contact pins, with each contact pin having a diameter, said lamp holder comprising:

a socket having two parallel slots defined by respective parts of parallel walls, each said slot configured for receiving one of the contact pins therein;

a conductor including a first contact portion associated with one said slots and a second contact portion associated with an other of said slots, each of said first and second contact portions including an edge having a notch configured to receive a respective one of the contact pins therein, each said edge and each said notch respectively disposed within said one slot and said other slot, each said edge and each said notch disposed adjacent to one of said parallel walls of the associated slot and away from the other of said parallel walls of the associated slot;

resilient means for biasing the contact pins out of said slots and means for allowing the contact pins to be moved away from said conductor by said resilient means when at least one of the contact pins is not received within a respective said notch, whereby arcing between said conductor and at least one of the contact pins is prevented, said allowing means comprising a clearance distance between each of said edges of said first and second contact portions and a respective and said other parallel wall, said clearance distance at all times, both when the contact pins are received and not received within said notched in said conductors, being greater than the diameter of the contact pins of the fluorescent lamp.

7. The lamp holder of claim 6, wherein said conductor comprises a one-piece conductor.

8. The lamp holder of claim 6, wherein said conductor comprises a first contact portion and a separate, second contact portion.

9. The lamp holder of claim 6, wherein said resilient means comprises at least one spring.

10. The lamp holder of claim 9, wherein said resilient means comprises two leaf springs.

11. The lamp holder of claim 6, wherein said notch is formed by the process of cutting out said notch from said conductor.

12. The lamp holder of claim 6, wherein said clearance distance is the same between each of said first and second contact portions and a respective said other parallel wall.

13. The lamp holder of claim 6, wherein said first and second contact portions are substantially flat.

* * * * *

UNITED STATES PATENT AND TRADEMARK OFFICE

CERTIFICATE OF CORRECTION

PATENT NO. : 5,688,139

DATED : November 18, 1997

INVENTOR(S) : Gust, et al.

It is certified that error appears in the above-identified patent and that said Letters Patent is hereby corrected as shown below:

COLUMN 6

Line 10, claim 6, delete "and", second occurance.

Signed and Sealed this

Seventeenth Day of February, 1998

Bruce Lehman

*Attest:*

BRUCE LEHMAN

*Attesting Officer*

*Commissioner of Patents and Trademarks*